United States Patent [19]

Peckels

[11] Patent Number: 4,997,013

[45] Date of Patent: Mar. 5, 1991

[54] LIQUID FILL LEVEL INDICATOR

[76] Inventor: Arganius E. Peckels, R.R. 2, P.O. Box 489, Ogilvie, Minn. 56358

[21] Appl. No.: 196,501

[22] Filed: May 20, 1988

[51] Int. Cl.[5] ..... B65B 39/04; B67C 11/00

[52] U.S. Cl. ..... 141/95; 141/96; 141/288; 141/297; 141/300; 141/331; 141/340; 73/294; 116/109; 116/112; 116/227

[58] Field of Search ..... 141/94–96, 141/297–300, 331–345, 288, 368; 73/294, 305, 306, 314, 319, 322, 322.5; 116/108–110, 112, 227, 228, 264, 70

[56] References Cited

U.S. PATENT DOCUMENTS

| | | | |
|---|---|---|---|
| 42,024 | 3/1864 | Smedley | 141/95 |
| 127,506 | 6/1872 | O'Laughlen | 141/95 |
| 374,875 | 12/1887 | Lyman | 141/95X |
| 586,411 | 9/1896 | Pratt | 141/288 |
| 641,267 | 1/1900 | Cahill | 141/297 |
| 790,463 | 5/1905 | Taliaferro | 73/294 |
| 843,873 | 2/1907 | De Veaux | 141/300 |
| 1,027,378 | 5/1912 | Dobartz et al. | 141/300 |
| 1,676,986 | 7/1928 | Hilford | 141/300 |
| 2,391,040 | 12/1945 | Scully | 141/96 |
| 2,666,557 | 1/1954 | Hester | 141/288 |
| 2,703,194 | 3/1955 | White | 141/96 |
| 2,831,452 | 4/1958 | Haynes | 141/95 |
| 2,910,097 | 10/1959 | Madsen | 141/96 |
| 2,935,099 | 5/1960 | Haynes | 141/95 |
| 3,136,295 | 6/1964 | Gramo | 141/95 |
| 3,411,553 | 11/1968 | Seto | 141/368 X |
| 3,420,281 | 1/1969 | Tidwell | 141/288 X |
| 3,927,703 | 12/1975 | Beaubien | 141/333 |
| 4,202,386 | 5/1980 | Orr | 141/300 |

*Primary Examiner*—Ernest G. Cusick
*Attorney, Agent, or Firm*—Henry C. Kovar

[57] ABSTRACT

An apparatus and a method for filling vessels with liquid has a non-electric fill indicator having an air passageway leading up and out of the vessel to an air flow indicator, air escaping during filling causes the indicator to whistle and when the whistle stops, the vessel is filled and the user stops filing; a funnel has an elongate air inlet port through a side wall to an adjustable height air inlet to the indicator, air flow is not stopped until the height level of opened air inlet port is covered by the vessel liquid.

9 Claims, 2 Drawing Sheets

LIQUID FILL LEVEL INDICATOR

BACKGROUND OF THE INVENTION

This invention pertains to a liquid fill level indicator and to a method of indicating when a fill level has been reached.

THE PRIOR ART

The manual filling of gasoline and fuel tanks from small transfer cans of the usual ½ to 6 gallon capacity is a sloppy procedure. The same holds true for the filling of these transfer cans as well as outboard motor cans, Jerry cans, boat tanks and so forth. Small fuel tanks are typically found on outboards, mowers, chainsaws, tillers, snowblowers, garden tractors, pumps, full size tractors, trucks, boats, generators, welders, cement and stucco mixers and so on. The typical practice is to fill these tanks until they overflow. Fuel then is spilled onto the ground or on the machine. This is a mess, it stinks, and its environmentally obectionable. It's quite common to fill these tanks at night or in relatively dark places when and where the filler can't see what's happening until the fuel runs over and splashes on the outside of the tank.

Much the same holds true for pesticides, herbicides, cleaning solutions, soft drink syrups, antifreeze, acids, alkalis, solvents, hot water and other liquids; they are all a problem to manual fill and tell when the receiving vessel is filled.

OBJECTS OF THE INVENTION

It is an object of the present invention to provide a liquid funnel having an improved structure for indicating when a vessel is filled.

It is an object of the present invention to provide an improved method of filling and a liquid funnel having an acoustical level control.

It is an object of the present invention to provide a method of filling and a liquid funnel with adjustment of indicated fill level.

It is an object of the present invention to provide a liquid vessel having an adjustable fill level indicator.

SUMMARY OF THE INVENTION

According to the principles of the present invention a liquid funnel has a generally tubular body with inlet and outlet ends, structure on the outet end for sealing the funnel to a vessel inlet, a discrete and relatively adjustable air tube extending upright in the the funnel, and structure on the air tube outlet end for indicating when air flow through the tube has been stopped by the level of liquid in the vessel.

A liquid funnel has a body with inlet and outlet ends, a discrete air passageway between the inlet and outlet ends, and an upright and elongate air inlet through the side of funnel body and into the air passageway.

An air vent and fill level indicator for a liquid vessel has an elongate air tube with inlet and outlet ends, an indicator on the outlet end for indicating passage or no passage of air therethrough, and a handle connected to the tube for manipulating the tube along up and down the tubes length while the tube has its inlet in the vessel.

Many other advantages, features and additional objects of the present invention will become manifest to those versed in the art upon making reference to the detailed description and accompanying drawings in which the preferred embodiment incorporating the principes of the present invention is set forth and shown by way of illustrative example.

DESCRIPTION OF THE PREFERRED EMBODIMENT

Figures 1, 2:
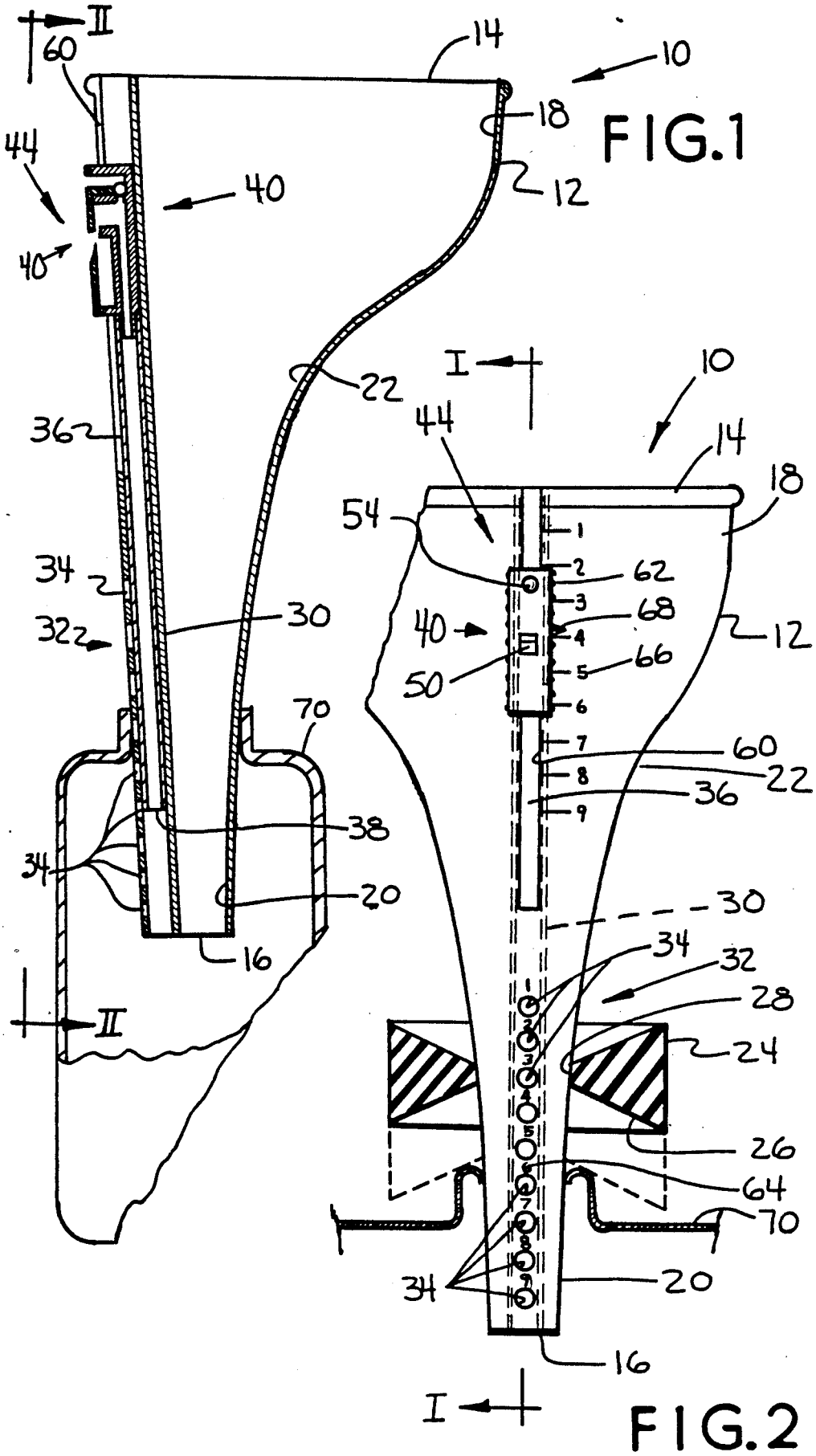
FIG. 1 is an elevational side view, in section, of the preferred embodiment of the funnel of the present invention.
FIG. 2 is a second elevational side view, taken from lines II—II of FIG. 1.
Figure 3:
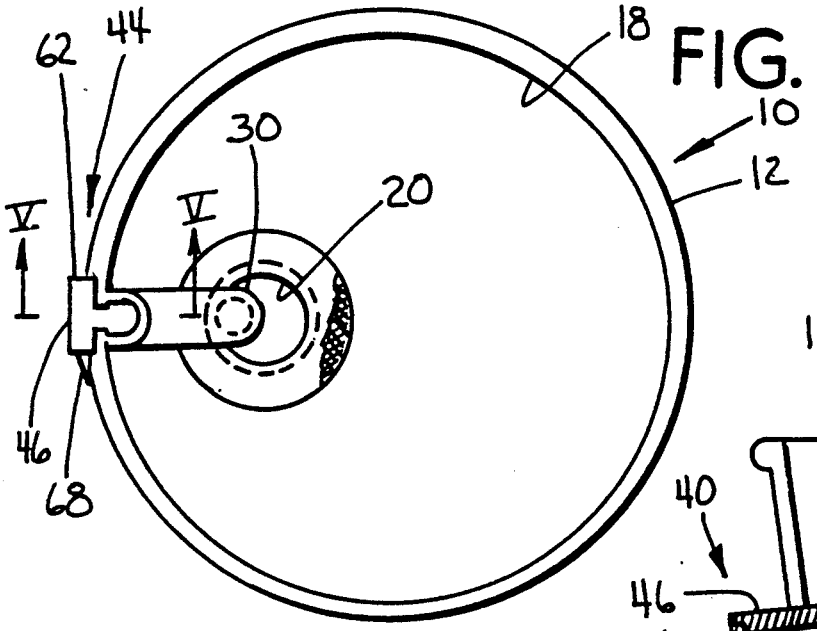
FIG. 3 is a top plan view of the structure of FIG. 1.

A liquid funnel for filling liquid vessels is shown in FIGS. 1–4 and is generally indicated by the numeral 10.

The funnel 10 has an upright generally tubular body 12 having an inlet end 14 and an outlet end 16. The inlet end 14 leads downward into a relatively large cross section and relatively large volume hopper 18. The outlet end 16 leads upward in and through a relatively small diameter discharge pipe 20. A relatively radial expanding cross-sectional area, which can be referred to as a flared section 22, is about midway between the inlet end 14 and the outlet end 16 and fluidly adjoins the hopper 18 to the discharge pipe 20. The discharge pipe 20 has a tubular frusto-conical section and has its smallest diameter at the outlet end 16. The discharge pipe 20 divergently tapers to a larger diameter away from the outlet end 16 and eventually adjoins the flared section 22. The exterior surface of the generally frusto-conical discharge pipe 20 preferrably has a concave curvature on the exterior as clearly seen in FIGS. 1 and 2. The discharge pipe 20 is sized and shaped to fit within and generally seal to the filling inlet aperture of fluid vessel 70.

It will be appreciated the discharge pipe 20 is sized and shaped to fit a reasonably similar group of vessels. As an example, a given single funnel 10 may have its discharge pipe 20 sized for the fuel tank fill apertures of mowers, garden tractors, tillers, snowblowers, small generators, and other relatively small domestic equipment. Another specific funnel 10 may be sized for boat fuel tanks. Another specific funnel may be sized for full size tractors and the like. Regardless, the discharge pipe 20 is sized and shaped to fit in and provide a reasonable, but not perfect, air tight seal between the discharge pipe 20 and the filling inlet aperture of the vessel to be filled. The concave exterior shape of the discharge pipe 20 helps seal the discharge pipe 20 to the filling inlet. There is at least one frequently encountered exception to the foregoing and this is the bayonet lock slotted filling aperture and cap on outboard fuel tanks. In order to seal to a slotted bayonet lock filling aperture, the discharge pipe 20 is provded with an external toroidal seal ring or element 24 that will slide up and down on the discharge pipe 20. The seal ring 24 is a soft resilient element made out of a soft elastomer, thermoelastomer, closed cell foam or similar material. The seal element 24 has a first downward facing annular face sealing surface 26 and a secod inner radial shaft or tube seal 28 that is sealing engagable with and against the outside surface of the discharge pipe 20. As at least part and preferrably most of the upright length of the discharge pipe 20 is inserted into a slotted bayonet lock fill spout as is best shown in FIG. 2, the seal ring 24 is pushed down against the spout and the face seal 26 provides a sufficiently air tight seal for the operation to be subsequently explained.

The funnel body 12 also includes a discrete internal relatively small diameter tubular section 30 that preferrably extends most or all of the way from the outlet end 16 to the inlet end 14. The tubular section 30 is in and is preferably on the inside of the funnel body 12 and is completely within the discharge pipe 20. A vertically elongate air inlet port generally indicated by the numeral 32 is open into the tubular section 30 through the exterior wall of the body 12, and specifically is open through the wall of the discharge pipe 20. The elongate air inlet port 32 has a height which is at least the majority of the height of the discharge pipe 20. The preferred structure of the air inlet port 32 is a plurality of aligned and spaced apart air aperture ports 34 that extend all the way up from the outlet end 16 to a level adjacent to the flared section 22.

Inside of the internal tubular section 30 is a discrete elongate air tube 36. The air tube 36 has a co-movable air inlet 38 which is adjacent and when lowered is preferrably co-planar with the body outlet end 16, and an air outlet end 40 adjacent the body inlet end 14. An open and relatively unobstructed air passageway 42 extends the height of the air tube 36 from the air inlet 38 to the air outlet end 40. The air tube 36 is slidably mounted inside the tubular section 30 and can be repeatedly pulled up and pushed back down within the funnel body 12.

Figure 5:
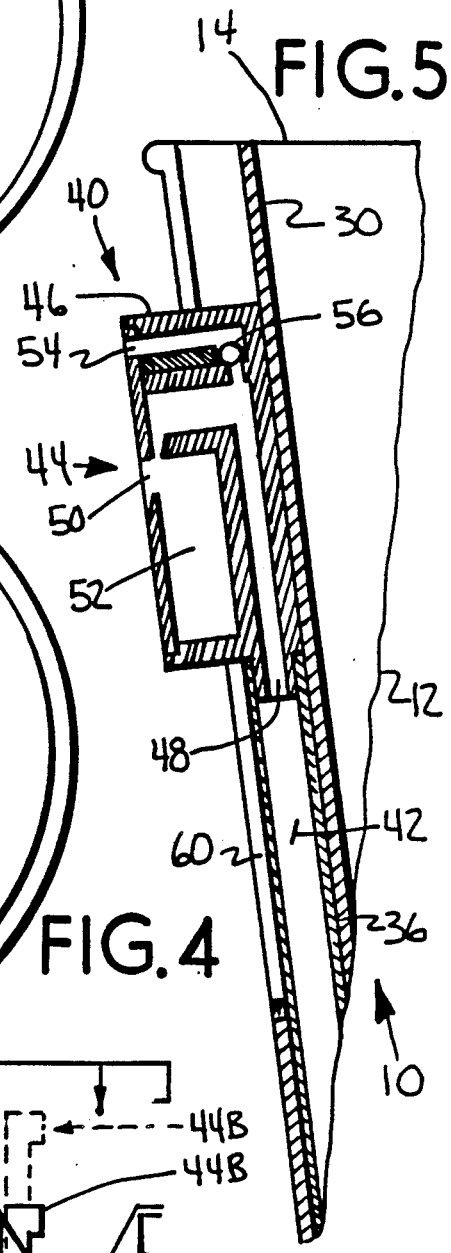
FIG. 5 is an elevational side view, in section and in detail, of the indicator of the structure of FIG. 1 as viewed through lines V—V of FIG. 3.
Figure 4:
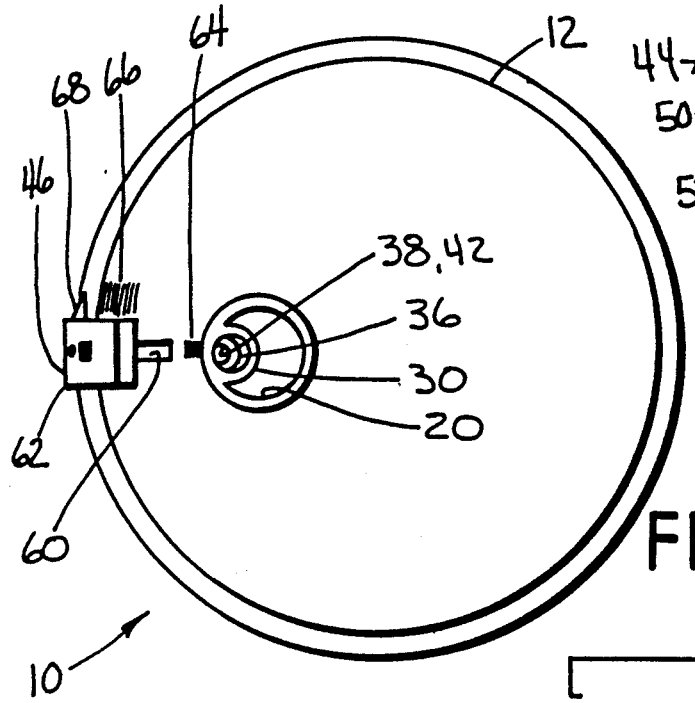
FIG. 4 is a bottom plan view of the structure of FIG. 1.

At the tube air outlet end 40 is an air flow indicator generally indicated by the numeral 44 that has structure for indicating whether or not air is flowing outward through the air tube 36. The specific construction of the air flow indicator 44 is best shown in FIG. 5. An indicator housing 46 has an air inlet 48 connected to the air tube 36. The air passageway 42 extends up and through the indicator housing 46 to an air outlet 50. Fluidly adjoined to the air outlet 50 is an acoustical resonance chamber 52 which makes the air flow indicator 44 audibly whistle when air is flowing up through the air tube 36 and out of the indicator air outlet 50. An air flow regulator outlet 54 is fluidly connected in parallel with the indictor air outlet 50 to the air tube 36. The regulator outlet 54 has a normally closed ball valve 56 that normally obstructs air flow through the regulator outlet 54. However, if and when the fill rate through the funnel 10 becomes excessive, the ball valve 56 will open and allow corresponding increased flow of air up and out of the air tube 36. The indicator housing 46, as best seen from the top in FIG. 3 has a generally T-shaped cross section with the central leg of the T-shape being in the tubular section 30 and with the head 58 of the T-shape being outside of the funnel body 12. The indicator housing 46 projects out of the funnel body 12 through an elongate adjustment slot 60 extending down from the funnel outlet end 16 and through the wall of the hopper 18 into the tubular section 30. A normally graspable handle 62 is formed in the indicator housing 46 for manual grasping and raising and lowering of the air tube 36 and the air inlet 38 in the tubular section 30. A first fill height gauge 64 is provided adjacent the elongate air inlet port 32 and a second fill height gauge 66 is provided adjacent the indicator housing 46 and the adjustment slot 60. The handle 62 preferrably has a height reference indicator 68.

In the use and operation of the funnel 10 and in the practice of the method of the present invention, the discharge pipe 20 of the funnel 10 is inserted into the fill aperture of a vessel to be filled with liquid. The fill aperture may be of unknown diameter. The concave exterior tapered surface of the discharge pipe 20 is sealed against the vessel inlet aperture. The user then looks at the side of the funnel 10 and in particular at the first fill height gauge 64 which will indicate how far the discharge pipe 20 is inserted into the vessel. The user then grasps the handle 62 and slides the air flow indicator 44 and air tube 36 up or down in the funnel body 12 as required until the indicator 68 on the second fill height gauge 66 is pointing at and is matched up with a quantity or level that corresponds to the quantity or level showing in the first fill height gauge 64 at the vessel fill aperture. This adjustment of the air tube 36 up and down, likewise adjusts the air tube air inlet 38 up and down to a predetermined height which is appropriately spaced below the level of the vessel fill aperture. The user then begins to pour liquid into the funnel 10. The liquid flows through the funnel body 12 and out of the body outlet end 16. As the liquid is flowing in, the air in the vessel is being displaced and must escape.

The escaping air goes up and out the air tube 36 via the air passageway 42 and goes out the air outlet 50 whereupon it causes the air flow indicator 44 to emit a shrill and easily heard whistle. The whistle sound continues as long as the vessel is being filled and as long as air is escaping out the air tube 36. As soon as the level in the vessel reaches the tube air inlet 38, the flow of air stops and the acoustic whistle stops and the user stops pouring because the vessel is filled. In as much as vessels vary, fill levels vary, and inlet apertures vary, the user most often never knows in advance where this fill level will be with respect to the funnel body 12 after the funnel 10 is inserted into the vessel. The fill height gauges 64, 66 enable the air tube 36 and air tube inlet 38 to be properly adjusted for a maximum fuel fill level or for the fill level to be adjusted downward from the top of the vessel. The liquid level reaching the funnel outlet end 16 may but does not necessarily stop the escaping air flow and whistle sound. As an example, if the discharge pipe 20 is inserted into the vessel up to the level of gauge mark "3" on the lower and first fill height gauge 64, the tube 36 and air inlet 38 will likewise be pulled up and raised in the funnel body 12 until the height indicator 68 is at the corresponding numeral "3" on the upper and second fill height gauge 66. The tube air inlet 38 will then be some predetermined distance below the mark "3" on the first fill height gauge 64, i.e., one inch below. The user of the funnel 10 will then be given an acoustical signal to stop filling when the liquid level is the predetermined level or distance, i.e. one inch below the top of the vessel. When the air tube 36 and air inlet 38 are raising up as just described, the fluid level in the vessel will reach the funnel outlet end 16 but not stop air flow. The air flow escapes out of the vessel by going through the uncovered individual air ports 34 until the highest uncovered air port 34 is covered by liquid at which time air flow stops and the indicator 44 so indicates by stopping the whistle sound. The indicator 44 indicates when air flow stops, and a full vessel is the course of of the stoppage of air flow.

Figure 6:
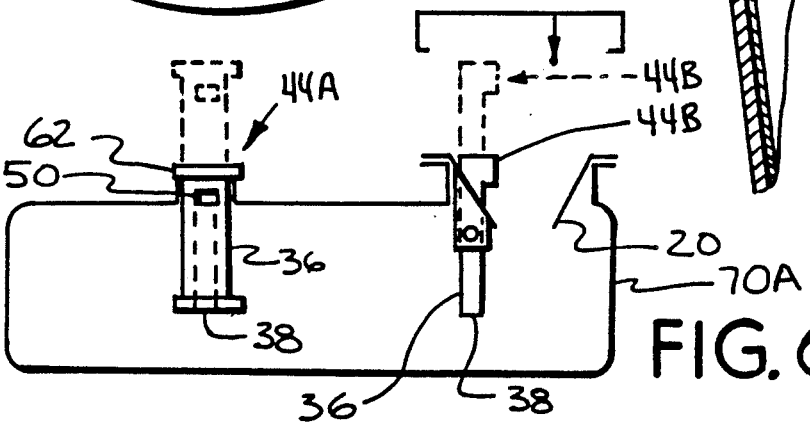
FIG. 6 is an elevational side view, in section, of a liquid vessel having the present invention therein.

The invention and method may be installed and used integrally into a liquid vessel 70*a* as is shown in FIG. 6*a*, wherein a stand alone alternative embodiment 44A is shown on the left and an in-the-filler and under-the-cap alternative embodiment 44B is shown on the right.

This funnel 10 and method are particularly well suited for filling fuel tanks, and for filling after dark and at and in time and places where it's hard to see. The funnel 10 is quite adaptable to many different kinds of vessels and fill apertures. This funnel 10 and method are extremely useful in any household, business or location wherein a vessel needs to be manually filled.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A liquid funnel having structure for indicating when liquid in a liquid receiving vessel has reached a selected and preferred fill level, comprising (a) a generally tubular funnel body having an inlet end and an outlet end;

(b) means adjacent the outlet end and adapted for generally sealing the funnel to a filling inlet of the liquid receiving vessel;

(c) a discrete air tube having an air inlet adjacent the body outlet end and an air outlet adjacent the body inlet end, said air tube being extended upright in said funnel and inside of said sealing means;

(d) indicator means on said air tube outlet for indicating air has stopped flowing through said tube upon the vessel being filled with liquid to the level of the air inlet, said air inlet being movable in said funnel body;

(e) moving means for vertically moving and positioning the air inlet up and down with respect to said funnel body in a plurality of fill levels which are spaced from the funnel outlet end;

(f) a first fill height scale extending upward from adjacent the outlet end of the funnel body;

(g) a second fill height scale extending downward from adjacent the inlet end of the funnel body; and (h) means adjacent said air outlet and said second scale for locating said air inlet at a selected and preferred fill level.

2. The funnel of claim 1, including adjustment means on the outside of said funnel body and below said inlet end, said adjustment means being operatively connected to said air tube and said locating means for adjusting and locating the air inlet, at a selected and preferred level from outside of the funnel, when the funnel is at least partially in the vessel.

3. The funnel of claim 1, wherein said funnel body includes a generally frusto-conical tubular section adjacent said outlet end for sealing in and to a range of diameters of filling inlets; and said sealing means comprising a toroidal seal ring sliding affixed and vertically adjustable on the outside of the funnel body frusto-conical tubular section adjacent the outlet end, said seal ring having (a) a first downward facing face sealing surface for sealing engagement of an outer face of bayonet type vessel filling inlet; and (b) a diametrically resilient inner radial seal sealing surface engagable with the outside of the funnel body along the frusto-conical tubular section adjacent the outlet end.

4. The funnel of claim 1, in which said first and second fill height scales are all on the outside of said funnel body.

5. An improved liquid funnel having structure for indicating when liquid in a liquid receiving vessel has reached a selected and preferred fill level, comprising (a) a generally tubular funnel body having an inlet end, an outlet end, and an outside wall between said ends;

(b) a generally frusto-conical discharge pipe, having a tapered section of said outside wall which is divergent from the outlet end toward the inlet end and which is sized and shaped to fit within different diameters of liquid filler inlet apertures for the receiving vessel;

(c) a discrete and vertically movable air tube having a movable air inlet adjacent the body outlet end and an air outlet adjacent the body inlet end, said air tube being extended upright in said funnel and inside of said frusto-conical discharge pipe;

(d) indicator means on said air tube outlet end and positioned on the outside of said funnel body for indicating air has stopped flowing through said tube upon the vessel being filled to the level of the movable air inlet;

(e) a vertically elongate air inlet port in the discharge pipe, said air inlet port being extended upward from adjacent the funnel outlet end and being extended through the funnel body outside wall fluidly to said air tube inlet; and (f) means adjacent the outlet end for effectively sealing the funnel and the vertically elongate air inlet port to the filling inlet of the liquid receiving vessel.

6. The funnel of claim 5, in which said sealing means comprises portions of said outside wall positioned inbetween vertically spaced apart portions of said vertically elongate air inlet port.

7. The funnel of claim 5, in which said air inlet port comprises a plurality of spaced apart apertures through said outer wall.

8. The funnel of claims 7, in which said plurality of apertures are in a straight line.

9. The funnel of claim 5, in which said tapered section is concave on the outside wall of the funnel body.

* * * * *